US008087326B2

(12) United States Patent
Nguyen et al.

(10) Patent No.: US 8,087,326 B2
(45) **Date of Patent: *Jan. 3, 2012**

(54) LOW PROFILE WRENCH AND METHOD

(75) Inventors: Peter D. Nguyen, Irvine, CA (US); Jerome C. Kraft, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/031,543

(22) Filed: Feb. 21, 2011

(65) Prior Publication Data

US 2011/0138970 A1 Jun. 16, 2011

Related U.S. Application Data

(63) Continuation of application No. 12/467,114, filed on May 15, 2009, now Pat. No. 7,905,162.

(51) Int. Cl.
*B25B 13/46* (2006.01)
*B25B 17/00* (2006.01)

(52) U.S. Cl. ..... 81/59.1; 81/57.3

(58) Field of Classification Search ..... 81/57.14, 81/57.29, 57.3, 58–58.5, 59.1, 60–63.2, 177.2
See application file for complete search history.

(56) References Cited

U.S. PATENT DOCUMENTS

| | | | | | |
|---|---|---|---|---|---|
| 2,691,316 | A * | 10/1954 | Brame | 81/61 |
| 3,343,434 | A * | 9/1967 | Schroeder | 81/60 |
| 3,838,614 | A * | 10/1974 | O'Donnell | 81/60 |
| 4,603,606 | A * | 8/1986 | Headen | 81/59.1 |
| 4,939,961 | A * | 7/1990 | Lee | 81/60 |
| 5,199,329 | A * | 4/1993 | Hsu | 81/59.1 |
| 5,509,331 | A * | 4/1996 | Nickipuck | 81/58.3 |
| 5,509,332 | A * | 4/1996 | Donaldson, Jr. | 81/59.1 |
| 5,517,884 | A * | 5/1996 | Sanders | 81/60 |
| 5,931,062 | A * | 8/1999 | Marcovici | 81/57.31 |
| 6,050,165 | A * | 4/2000 | Hall | 81/63.1 |
| 6,202,513 | B1 * | 3/2001 | Pan | 81/59.1 |
| 6,898,998 | B2 * | 5/2005 | Shyu | 81/63.1 |
| 7,150,208 | B2 * | 12/2006 | Debley | 81/59.1 |
| 7,281,452 | B2 * | 10/2007 | Chang | 81/60 |
| 7,497,149 | B2 * | 3/2009 | Lin | 81/62 |
| 2009/0090224 | A1 * | 4/2009 | Lin | 81/177.2 |

* cited by examiner

*Primary Examiner* — David B Thomas
(74) *Attorney, Agent, or Firm* — Novatech IP Law; Sean O'Neill; Dennis Plank

(57) ABSTRACT

A member may be rotated by engaging the member with a drive element and rotating the drive element in a single direction such that rotation in an opposite direction is prevented.

19 Claims, 8 Drawing Sheets

LOW PROFILE WRENCH AND METHOD

CROSS-REFERENCE TO RELATED APPLICATIONS

This application is a continuation of and claims priority to U.S. application Ser. No. 12/467,114 filed on May 15, 2009 and entitled LOW PROFILE WRENCH, the entire contents of which is expressly incorporated herein by reference.

STATEMENT RE: FEDERALLY SPONSORED RESEARCH/DEVELOPMENT (Not Applicable)

FIELD

The present disclosure relates generally to hand tools and, more particularly, to tools and methods for accessing fasteners installed in areas with limited overhead space or limited rotational space.

BACKGROUND

Limited accessibility to fasteners is a common problem in many industries. In the aerospace industry, the problem of limited access to fasteners may be more pronounced due to more stringent engineering requirements and the smaller space constraints associated with aerospace structures. Furthermore, a relatively large quantity of fasteners may be used in the aerospace industry as compared to other industries. For example, hundreds of thousands of fasteners may be used in a single aircraft. A fair percentage of such fasteners may be installed in areas where access is limited.

For example, many aircraft include stiffeners or stringers which may be coupled to a skin member in order to increase the stiffness of the skin member. Such stringers may include a base having a vertical web extending upwardly from the base with a lateral flange extending outwardly from the vertical web. The lateral flange may extend over a row of fasteners which fasten the base of the stringer to the skin member. Unfortunately, the lateral flange may prevent vertical access to the fastener using conventional tools such as a conventional socket wrench. The limited amount of space between the fastener and the lateral flange may also limit access to the fastener using conventional hand tools such as a conventional box end wrench or open end wrench.

Certain installations in confined spaces may limit the ability to rotate such fasteners for installation or removal of the fastener using conventional tools. For example, structure that is located on opposing sides of a fastener installation may restrict fastener rotation to a fraction of the total that is required to fully disengage a nut from a threaded stud. The limited amount of rotation may require repeated cycles of installing and removing a conventional wrench from the fastener due to the limited angle through which the nut can be rotated during each cycle. As may be appreciated, limited rotational angles may increase the amount of time required to complete fastener installations using conventional hand tools.

In efforts to improve access to such fastener installations or to reduce the amount of time required to complete such fastener installations, technicians may resort to modifying commercially available tools to fit a specific installation. Although such tools may be effective in accessing certain fastener, such modified tools may be retained by the individual technician working at the specific location and may therefore be unavailable to technicians working in other locations of the same facility. In this regard, awareness of the existence of such modified tools may be confined to the individual technician and to team members of the technician.

Although tools may be modified to improve access to fasteners with limited overhead space, other limitations associated with conventional tools may present further challenges to certain installations. For example, ratchet mechanisms commonly used in conventional hand tools possess certain drawbacks that may reduce the ability to remove or install fasteners with limited rotational space. More specifically, conventional ratchet wrenches typically comprise a ratchet and pawl arrangement wherein a pivoting pawl engages teeth formed on a ratchet wheel. Such ratchet and pawl arrangements limit rotation of the wrench to a single driving direction (e.g., for loosening or tightening a nut or bolt) and allow free rotation of the wrench in a reverse direction without the need to remove the tool from the fastener.

Unfortunately, conventional ratchet and pawl arrangements exhibit a certain amount of backlash wherein the ratchet must be rotated in the reverse direction by a minimum angular amount prior to re-engagement of the ratchet in the drive direction. For fastener installations wherein rotational access is limited, excessive backlash may minimize the effectiveness of conventional ratchet and pawl wrenches in removing or installing fasteners. Although wrenches with reduced backlash are commercially available, such wrenches are typically provided in increased thicknesses which restrict the use of such wrenches in installations where overhead access is limited.

As can be seen, there exists a need in the art for a wrench that facilitates access to fasteners installed in confined spaces. More specifically, there exists a need in the art for a wrench that provides convenient access to fastener installations in locations with limited overhead space and/or limited rotational space. Additionally, there exists a need in the art for a wrench which reduces or eliminates backlash in order to improve the effectiveness of such wrenches in fastener installations having limited rotational space. Finally, there exists a need in the art for a wrench having the above-described attributes and which is simple in construction and low in cost.

SUMMARY

The above-noted needs associated with limited-access fastener installations are specifically addressed by the present disclosure which provides a wrench which may be used for rotating a member such as a fastener (e.g., nut, bolt, etc.) and wherein the wrench is provided with a substantially low profile or in a reduced thickness in order to allow access to fastener installations having limited overhead space. Furthermore, the wrench is specifically adapted to provide improved effectiveness in fastener installations having limited rotational space by including a drive mechanism having a nonreversible or unidirectional roller clutch to minimize or eliminate backlash in the wrench.

The wrench may comprise a generally elongate body having a tool end and a handle end. The body may include a head portion and a handle portion. The drive mechanism may be housed within a chamber formed in the head portion. The drive mechanism may comprise a clutch gear and a drive gear. The drive gear may be adapted to engage a member such as a fastener for rotation thereof. Although the member may be configured as a fastener such as a nut or a bolt, the member may be configured in any fastener or non-fastener configuration and is not limited to a conventional fastener such as a nut or a bolt.

The drive gear may include drive gear teeth configured to engage clutch gear teeth of the clutch gear. The clutch gear may be supported on the unidirectional roller clutch. The unidirectional roller clutch may comprise an outer race disposed in coaxially spaced relation to an inner race using a plurality of bearing elements interposed between the inner and outer races. The bearing elements may be configured as ball bearings, needle rollers or any other suitable bearing element arrangement or combination thereof. The roller clutch is configured such that the outer race may rotate in a single direction relative to the inner race while preventing rotation thereof in an opposite direction.

Advantageously, by incorporating the roller clutch into the drive mechanism, the wrench may be provided in a low profile configuration of generally reduced thickness as compared to conventional ratchet wrenches. Furthermore, the incorporation of the roller clutch into the drive mechanism provides a ratchet wrench having generally minimal or essentially zero backlash. In an embodiment, the drive gear and the clutch gear may be mounted to or may be housed within a body of the wrench. For example, the wrench may include upper and lower housings which may collectively form a chamber for housing the drive mechanism. The upper housing may be configured to be removable from the lower housing and, in this regard, may include an interlocking mechanism and/or one or more housing fasteners engageable into housing bores formed in the lower housing. However, the body may be provided in a variety of alternative configurations for housing the drive mechanism.

The technical benefits of the disclosed embodiments include an increase in accessibility of certain fastener installations wherein overhead space and/or rotational space is limited. The increased accessibility to fastener installation is due in part to the reduced overall thickness of the wrench as compared to conventional wrenches. For example, the wrench may be provided in a thickness of 0.19 inch or less although the wrench may be provided in any thickness. By increasing accessibility to fastener installations, cycle time in installing and/or removing such fasteners may be reduced. Furthermore, the low profile wrench as disclosed herein may reduce the quantity of tool configurations that may be otherwise maintained for a given application or location in a manufacturing or maintenance facility. In this regard, the low profile wrench may reduce production time by providing a tool allowing access to a wide range of fastener installations. Advantageously, the low profile wrench may include the interlocking mechanism for mechanically coupling the upper and lower housings in a manner that reduces flexing of the wrench in response to bending moment forces induced in the wrench when rotating a fastener such as during tightening or torquing of the fastener.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numerals refer to like parts throughout and wherein.

DETAILED DESCRIPTION

Figure 1:
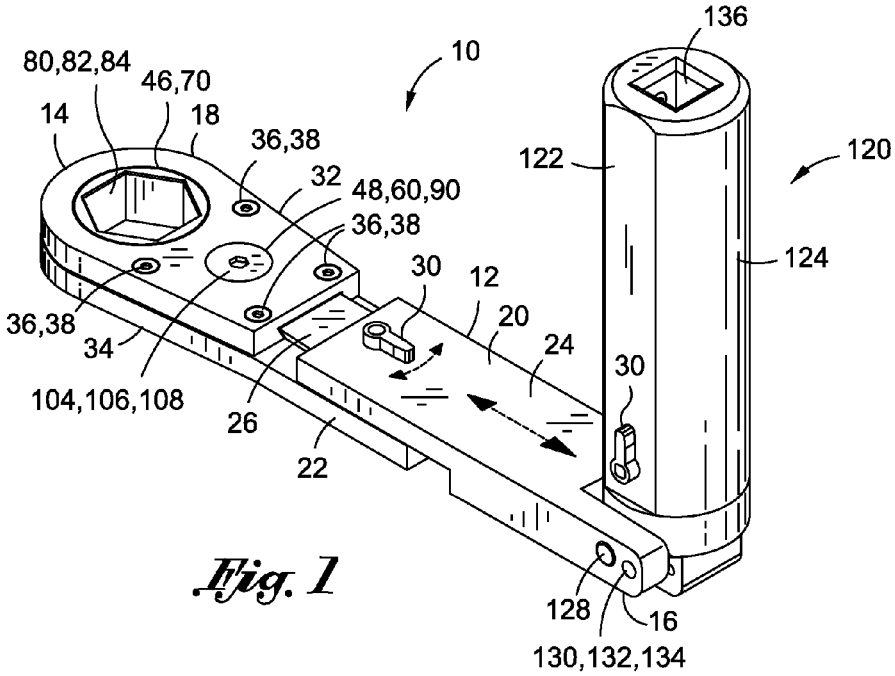
FIG. 1 is a perspective illustration of a wrench having a head portion and a handle portion to which a gripping portion may be pivotably attached.
Figure 2:
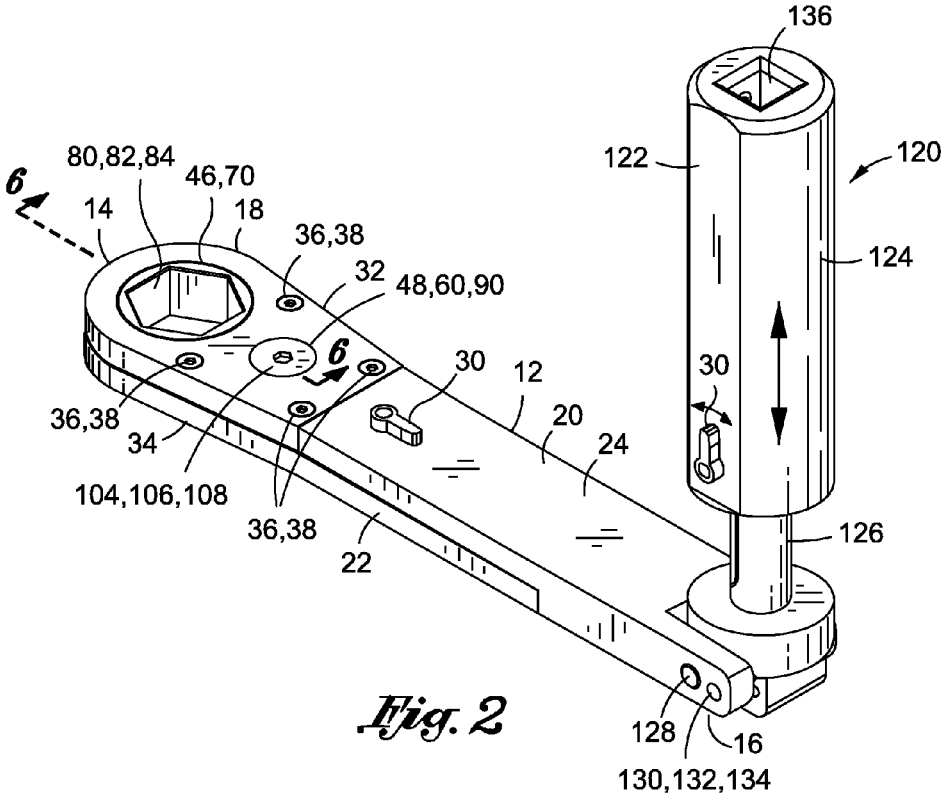
FIG. 2 is a perspective illustration of the wrench similar to that which is illustrated in FIG. 1 and further illustrating the gripping portion having a grip body which may be axially extensible along a grip shaft of the gripping portion.
Figure 3:
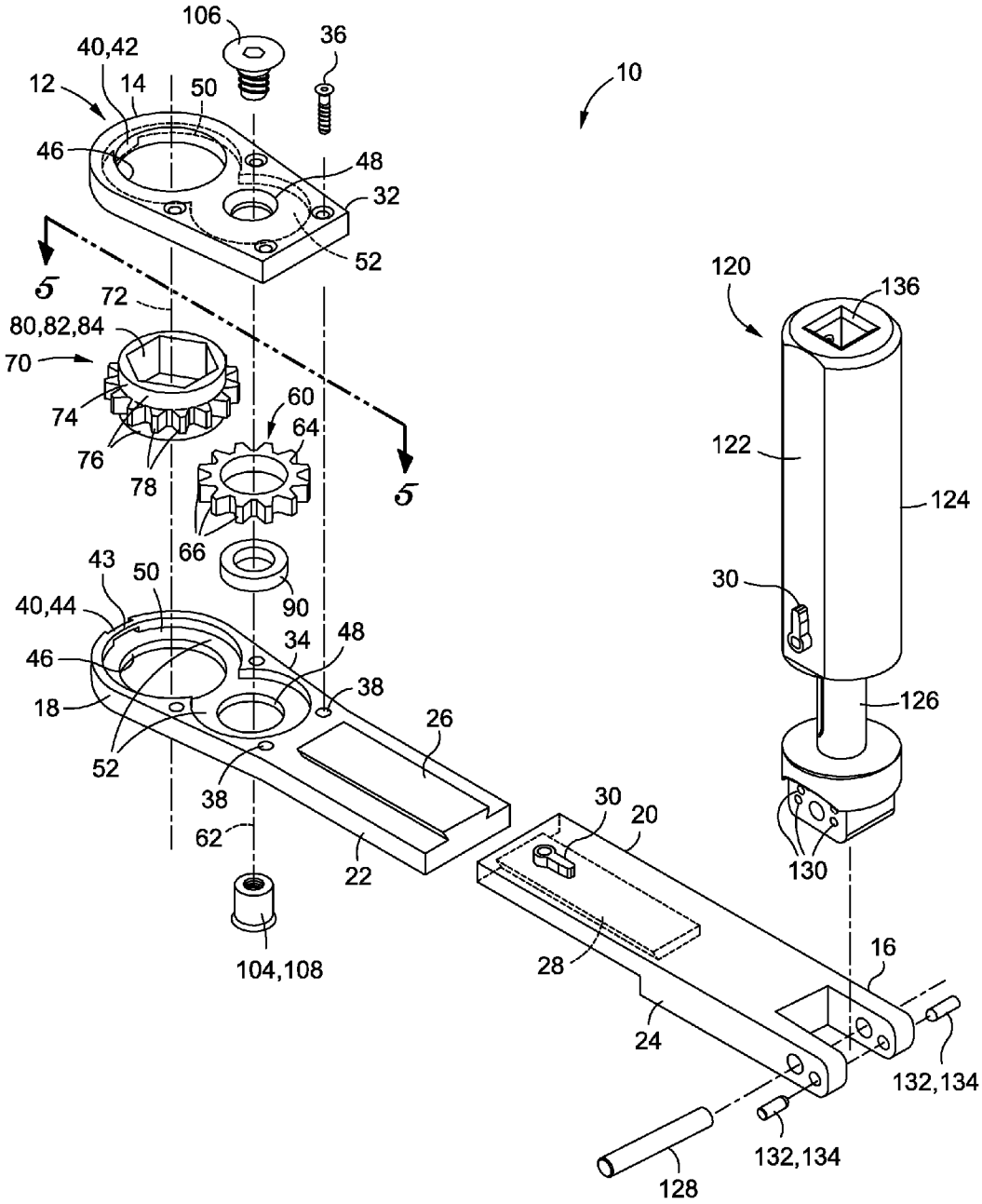
FIG. 3 is an exploded perspective illustration of the wrench illustrating the drive mechanism comprising the drive gear and the clutch gear housed within a lower housing and an upper housing at the head portion.

Referring now to the drawings wherein the showings are for purposes of illustrating preferred and various embodiments of the disclosure only and not for purposes of limiting the same, shown in FIGS. 1-3 is a low profile wrench 10 for use in fastener 160 installations with reduced overhead accessibility and/or reduced rotational accessibility. In a broad sense, the wrench 10 comprises an elongate body 12 and a drive mechanism 80 incorporated into the body 12. The drive mechanism 80 may be supported on a nonreversible, unidirectional roller clutch 90. Advantageously, the unidirectional roller clutch 90 provides a ratcheting mechanism having minimal or essentially zero backlash.

Referring particularly to FIGS. 1 and 2, in an embodiment, the body 12 of the wrench 10 may have opposing ends comprising a tool end 14 and a handle end 16 and including a head portion 18 and a handle portion 20. The drive mechanism 80 may be generally housed within or mounted to the head portion 18. The handle portion 20 may have a generally elongate configuration of generally high aspect ratio wherein a length of the handle portion 20 may be generally greater than a width thereof. Likewise, the width may be generally greater than a thickness of the wrench 10 although the handle portion 20 may be provided in any configuration having any relative length, width and thickness dimensions.

As can be seen in FIGS. 1-3, the body 12 may include a lower housing 34 and an upper housing 32 which may be removably secured to the lower housing 34 such as by means of one or more housing fasteners 36 and/or an interlocking mechanism 40 as described in greater detail below. The upper and lower housings 32, 34 may form at least a portion of the head portion 18. The housing fasteners 36 may be threadably engaged to a corresponding number of fastener bores 38. The housing fasteners 36 may optionally be configured as countersunk fasteners 160 in order to provide a generally flush upper surface of the body 12 and to maintain a generally low profile configuration of the wrench 10. Although the upper housing 32 is shown as being mechanically secured to the lower housing 34 by means of housing fasteners 36 and/or the interlocking mechanism 40, the upper housing 32 may be secured to the lower housing 34 by alternative fastening means. For example, the upper housing 32 may be secured to the lower housing 34 by mechanical features incorporated into the respective upper and lower housings 32, 34 or by non-mechanical means. As indicated above, at least one of the upper and lower housings 32, 34 may include one or more interlocking mechanisms 40 to mechanically connect or secure the upper and lower housings 32, 34 at the tool end 14 as will be described in greater detail below.

The body 12 may include the handle portion 20 which, in an embodiment, may comprise a movable portion 24 mounted to a fixed portion 22 as shown in FIGS. 1 and 2. In this regard, the body 12 may be extended to an increased length wherein the movable portion 24 may be axially extensible relative to the fixed portion 22. Toward this end, the fixed portion 22 may include a track 26 or other suitable feature to engage a mating feature in the movable portion 24 such as the groove 28 illustrated in FIG. 3. However, the extensible capability of the movable portion 24 relative to the fixed portion 22 may be facilitated by incorporating any number of alterative mechanisms into the movable portion 24 and/or fixed portion 22.

In an embodiment of the wrench 10, the track 26 and groove 28 or functional equivalent is preferably sized and configured to provide sufficient strength and resistance to the body 12 against bending forces induced during torquing or rotation of a member 158 such as a fastener 160. The track 26 may be formed in a cross section that maintains engagement with the groove 28. For example, the track 26 and groove 28 may each include inwardly angled side walls or other features such that the fixed and movable portions 22, 24 are maintained in contact with one another regardless of the relative axial positioning of the fixed and movable portions 22, 24. It should be noted that although the wrench 10 is illustrated as having a body 12 including the movable portion 24 and the fixed portion 22, the wrench 10 may be provided in a configuration wherein the body 12 is non-extensible. For example, the lower housing 34 may be formed as a fixed-length structure extending from the tool end 14 to the handle end 16.

Referring still to FIGS. 1-3, the handle end 16 of the body 12 may optionally include a gripping portion 120 which may be pivotably mounted to the handle portion 20 via a pivot pin 128. The gripping portion 120 may be configured to be extensible along an axial length thereof in order to increase a length of the gripping portion 120 and to increase the moment arm of the wrench 10. The extensibility of the gripping portion 120 may also improve accessibility to fastener 160 installations wherein the gripping portion 120 may be pivoted to avoid interference with structure or to facilitate manipulation of the wrench 10 by a technician during removal or installation of a fastener 160. In this regard, the gripping portion 120 may include a plurality of detents 130 configured to be engageable by a corresponding engagement mechanism such as a pin or a ball 132 which may be biased into one of the detents 130 by a biasing mechanism 134 such as a spring. Optionally, the gripping portion 120 may be fixed in a desired angular orientation by means of a set screw or other feature which may engage the detents 130. In this manner, the gripping portion 120 may be pivoted into one of a plurality of different angular orientations of the gripping portion 120 relative to the body 12.

Figure 10:
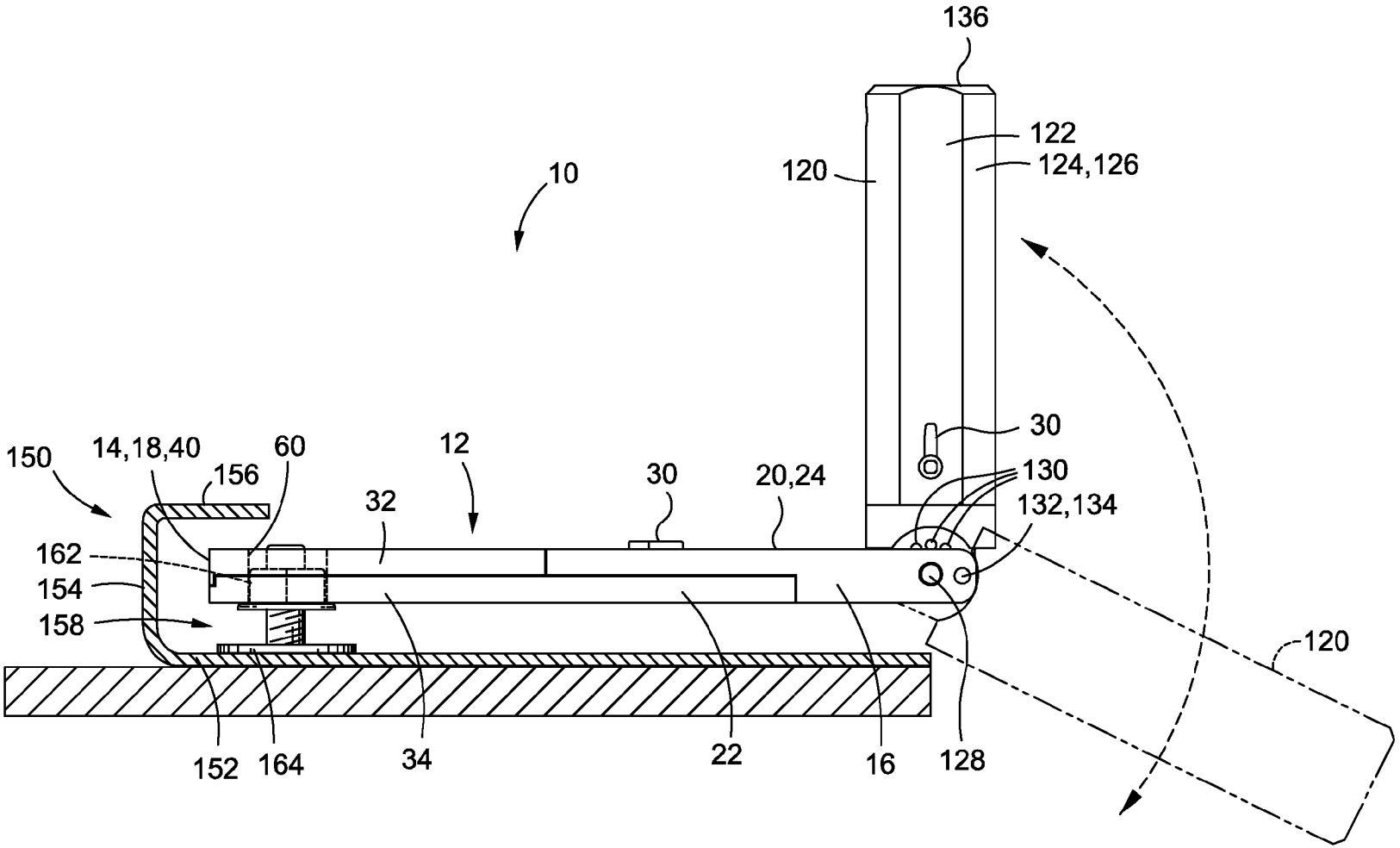
FIG. 10 is a side illustration of the wrench and fastener installation taken along line 10-10 of FIG. 9 and further illustrating the limited overhead access of the fastener installation.

For example, as shown in FIGS. 1-3, the gripping portion 120 is oriented generally perpendicularly relative to the body 12. However, as shown in FIG. 10, the gripping portion 120 may be oriented to be generally co-planar with the body 12 in order to increase the amount of leverage that may be applied at the tool end 14 of the wrench 10. It should be noted that although the wrench 10 is illustrated in the Figures as having the gripping portion 120 positioned at different orientations by engaging the detents 130 formed in the base thereof, a variety of alternative mechanisms may be incorporated into the wrench 10 to facilitate the angular positioning of the gripping portion 120. For example, the body 12 may include a set of mating fixtures formed on an inner side of the handle end 16 and gripping portion 120 in order to lock the gripping portion 120 at a desired orientation. Alternatively, the wrench 10 may include a nut and bolt combination which may act as the pivot pin 128 and which may cooperate with surface features (not shown) formed at the interface between the gripping portion 120 and the handle end 16. In such an arrangement, tightening of the nut and bolt results in engagement of the gripping portion 120 to the handle portion 20 to maintain a desired orientation of the gripping portion 120.

In an embodiment, the gripping portion 120 may be omitted from the wrench 10 such that the wrench 10 comprises the body 12 extending from the tool end 14 to the handle end 16. The body 12 may be provided in any length and in any shape and is not limited to the linear or generally planar or straight configuration illustrated in the Figures. For example, the body 12 may include one or more curves oriented in any direction and which may be tailored for use in a specific application or for use with a specific fastener 160 installation. Furthermore, it is contemplated that the body 12 may incorporate an ergonomic shape at the handle end 16 to facilitate grasping and manipulation of the wrench 10 by an operator.

Referring still to FIGS. 1-3, the gripping portion 120 may include a grip body 126 which may be axially extensible along a grip shaft 124 as shown in FIG. 2. The axially extensible grip body 126 may improve the adaptability of the wrench 10 for use in different applications. For example, with the gripping portion 120 positioned in a generally perpendicular orientation relative to the body 12, axially extending the grip body 126 along the grip shaft 124 may effectively increase the moment arm of the wrench 10. Axial movement of the grip body 126 relative to the grip shaft 124 may be facilitated by initially actuating a latch 30 as illustrated in FIGS. 1-3 or by another suitable mechanism.

The latch 30 may be configured to lock the position of the grip body 126 at a location along the grip shaft 124. For example, actuating the latch 30 may unlock the grip body 126 to allow movement of the grip body 126 along the grip shaft 124. In a similar manner, the latch 30 may be provided on the handle portion 20 of the wrench 10 to facilitate locking and unlocking of the movable portion 24 relative to the fixed portion 22 to allow axial extension of the body 12. However, the latches 30 shown in the Figures are representative of any one of a variety of different mechanisms by which the movable portion 24 and grip body 126 may be locked and unlocked relative to respective ones of the fixed portion 22 and grip shaft 124.

Referring still to FIGS. 1-3, the gripping portion 120 may optionally include a drive opening 136 formed in a free end of the grip body 126 to facilitate engagement of a square drive tool such as a conventional ratchet drive in order to increase the amount of leverage that may be applied to a member 158 or fastener 160. In this regard, the grip body 126 may optionally include one or more surface features such as the flats 122 formed on opposing sides of the grip body 126 as illustrated in FIGS. 1-3. By providing flats 122 on opposing sides of the grip body 126, an open end wrench, crescent wrench or other suitable tool may be used to engage the gripping portion 120 in order to increase the torque that may be applied to a fastener 160. The grip body 126 may be provided in any configuration and, preferably, is preferably formed in a size and shape that may be readily or conveniently grasped and manipulated by a user. For example, the grip body 126 may have a generally cylindrical shape with a diameter of approximately 0.5 inches to approximately 1.5 inches although the grip body 126 may be formed in any size, shape and configuration.

Figure 4:
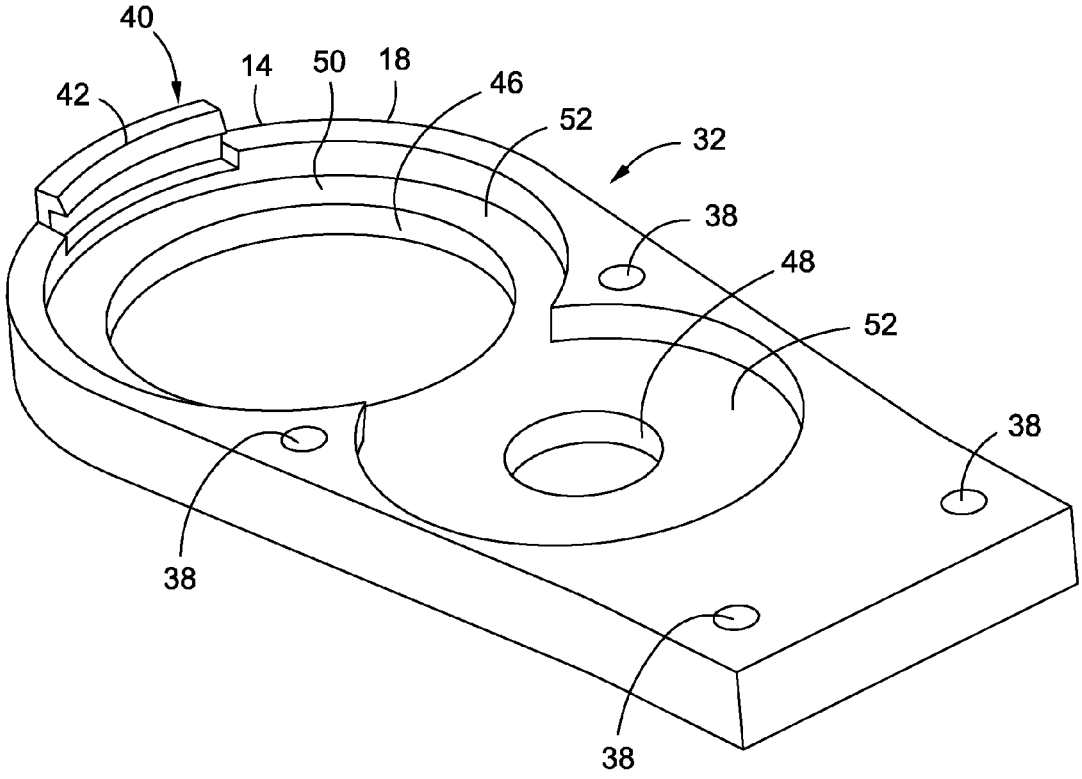
FIG. 4 is a perspective illustration of the upper housing in an orientation which is flipped vertically relative to the orientation of the upper housing shown in FIG. 3 and further illustrating an interlocking mechanism formed on the upper housing for coupling the upper housing to the lower housing.

Referring to FIGS. 3-4, shown in FIG. 4 is the upper housing 32 in an orientation that is flipped vertically relative to the orientation shown in FIG. 3. As can be seen, the upper housing 32 may include one or more housing recesses 52 configured to contain or house the clutch gear 60 and the drive gear 70. The clutch gear 60 is rotatable on the clutch gear axis 62. The drive gear 70 is rotatable on the drive gear axis 72. In an embodiment, the housing recess 52 provided in the upper housing 32 and the lower housing 34 may collectively form a chamber 50 that is sized and configured to house the drive gear 70 and the clutch gear 60. Each one of the housing recesses 52 may be formed as a partial cylindrical bore or in any other suitable shape for providing rotating clearance for the clutch gear 60 and drive gear 70. The housing recesses 52 may be positioned in adjoining relationship to one another. Each one of the housing recesses 52 may be defined by walls extending around a perimeter of the housing recesses 52 and defining the chamber 50.

In this regard, the generally equal thickness of the upper and lower housings 32, 34 as shown in FIGS. 1-6 is illustrative of an embodiment of the wrench 10 and is not be construed as limiting alternative configurations, shapes and sizes (e.g., thicknesses) of the upper and lower housing 32, 34 for housing the clutch gear 60 and drive gear 70. For example, the lower housing 34 may be formed at a greater thickness as compared to a thickness of the upper housing 32 such that the lower housing 34 may house a majority of the drive gear 70 and the clutch gear 60. In such an embodiment, the upper housing 32 may be generally configured as a plate that may be devoid of housing recesses 52 and which may only include a drive gear bore 46 and a clutch gear bore 48. In such a plate configuration, the upper housing 32 may function as a means to close off the lower housing 34 for containing or housing the drive gear 70 and the clutch gear 60.

Referring to FIGS. 3-6, in an embodiment, the head portion 18 of the body 12 may include the interlocking mechanism 40 in at least one of the upper and lower housings 32, 34 as mentioned above. The interlocking mechanism 40 may be configured to mechanically connect the upper and lower housings 32, 34 together at the tool end 14 for increasing the rigidity and stiffness of the wrench 10. Furthermore, as compared to conventional ratchet wrenches, the interlocking mechanism 40 may provide improved resistance to flexing or bending of the wrench 10 in response to bending moment forces induced in the body 12 when torquing a fastener 160 or other member 158 configuration.

For example, in an embodiment, the interlocking mechanism 40 may include a locking tab 42 that may be formed in the upper housing 32 as shown in FIG. 4 for engaging a locking bridge 43 and locking recess 44 that may be formed in the lower housing 34 as best seen in FIG. 3. In an embodiment shown in FIGS. 3 and 5-6, the locking bridge 43 may extend across a gap in the wall of the lower housing 34. Alternatively, the locking tab 42 may be formed in the lower housing 34 with the locking recess 44 and locking bridge 43 being formed in the upper housing 32. In this regard, it should be noted that the interlocking mechanism 40 may be formed in a variety of different sizes, shapes and configurations and is not limited to the configuration having the locking tab 42, locking bridge 43 and locking recess 44 as illustrated in the Figures. For example, the locking bridge 43 may be configured as a lip (not shown) extending laterally outwardly from the wall of the lower housing 34 to engage the locking tab 42 of the upper housing 32. Such a configuration of the locking bridge 43 may provide enhanced resistance to vertical loads imposed thereon by the locking tab 42. In addition, such a configuration may provide increased torsional rigidity and bending moment resistance to the body 12 of the wrench 10.

Figure 6:
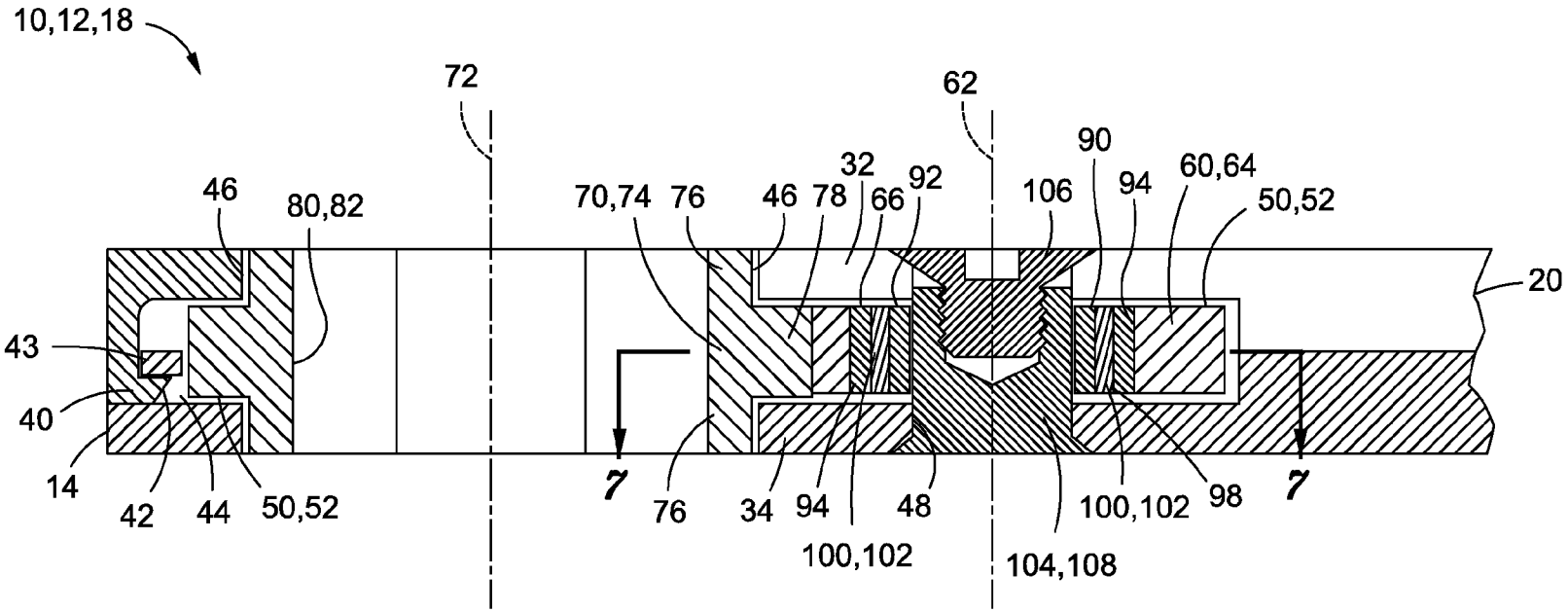
FIG. 6 is a sectional illustration of the head portion taken along line 6-6 of FIG. 2 and illustrating the drive gear and clutch gear housed within a chamber formed within the head portion.

The interlocking mechanism 40 may be located at the tool end 14 as shown although it is contemplated that the interlocking mechanism 40 may be located at any position along the interface between the upper and lower housing 32, 34 and is not limited to being located at the tool end 14. The location of the interlocking mechanism 40 at the tool end 14 of the body 12 may facilitate assembly and maintenance of the wrench 10 by providing a means by which the upper housing 32 may be removably engaged to the lower housing 34. For example, as best seen in FIGS. 4 and 6, the locking tab 42 may be chamfered at a free edge thereof to facilitate engagement of the locking tab 42 with the locking recess 44 and locking bridge 43 when the upper housing 32 is assembled to the lower housing 34. In addition, as shown in FIG. 6, the locking tab 42 may be formed with an undercut or radius at the intersection of the locking tab 42 and the upper housing 32 as shown in FIG. 6 to facilitate engagement of the locking tab 42 into the locking recess 44 during assembly of the upper and lower housings 32, 34. The locking tab 42 is preferably sized and configured to provide a relatively snug fit within the locking recess 44 to prevent axial, lateral and/or twisting movement of the upper housing 32 relative to the lower housing 34 at the tool end 14. During tightening or torquing of a fastener 160, the relatively snug fit between the locking tab 42, locking bridge 43 and locking recess 44 may prevent lateral movement of the upper housing 32 relative to the lower housing 34.

Figure 5:
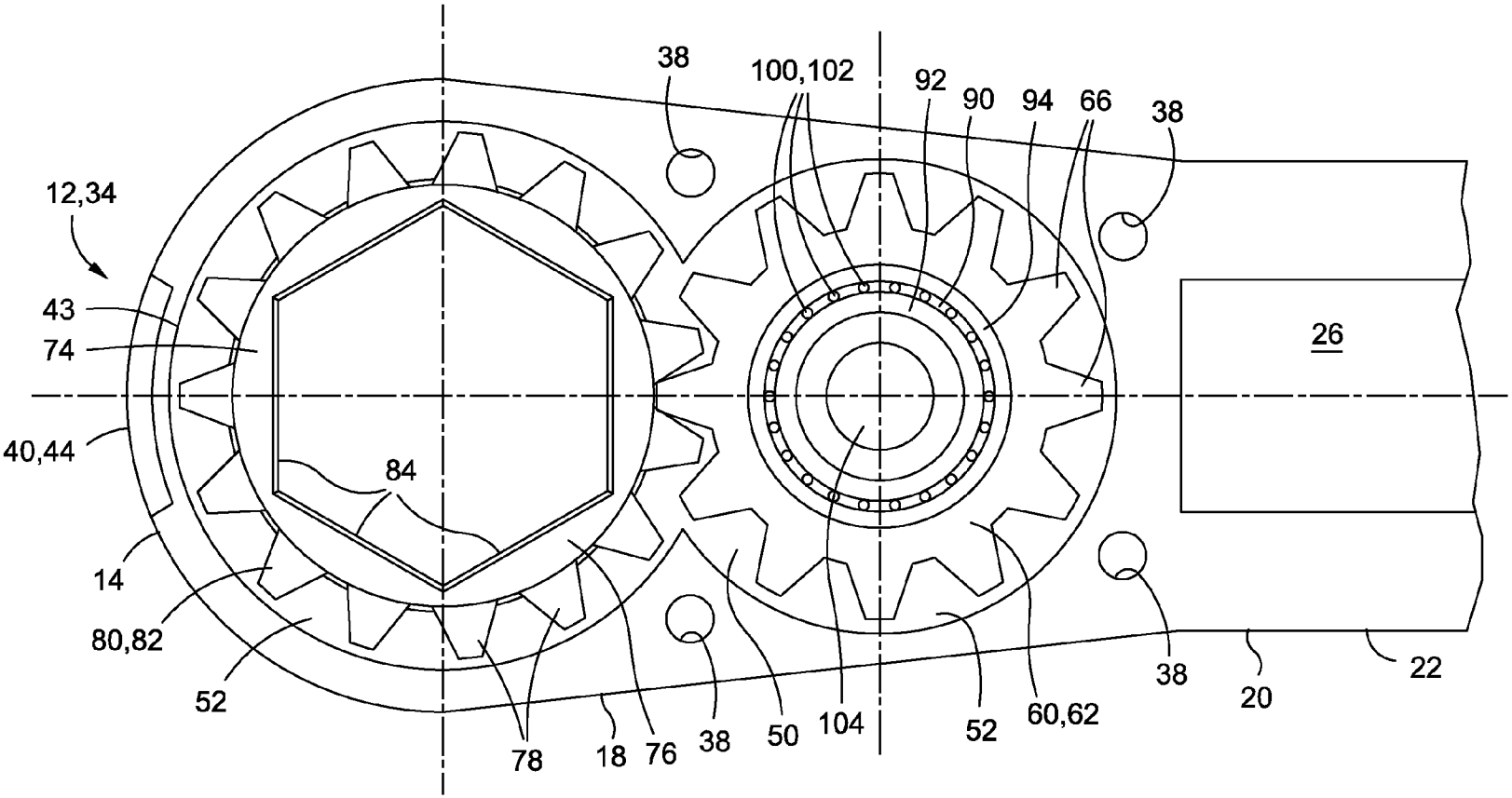
FIG. 5 is a plan view of the head portion taken along line 5-5 of FIG. 3 and illustrating the interconnectivity of the drive gear to the clutch gear and further illustrating the clutch gear rotatably supported on the nonreversible roller clutch.

Further in this regard, the locking tab 42 is preferably provided in a thickness that is complementary to a height of the locking recess 44 such that axial movement of the upper housing 32 relative to the lower housing 34 is prevented or minimized. Likewise, the locking tab 42 is preferably sized to be maintained in contacting engagement with opposing sides of the locking recess 44 such that lateral or side-to-side motion of the upper housing 32 relative to the lower housing 34 is prevented or minimized. For example, the locking tab 42 and locking recess 44 may be formed in a wedge shape as shown in FIG. 5 to provide a snug fit therebetween. In this manner, the upper housing 32 may be rigidly secured to the lower housing 34 by means of the interlocking mechanism 40 and/or the housing fasteners 36 which may be extended into a corresponding number of fastener bores 38 at any location along the upper and lower housing 32, 34.

In an embodiment, the upper housing 32 may extend along a full length of the body 12 from the tool end 14 to the handle end 16 and is not limited to being located at the tool end 14 of the body 12. Likewise, the lower housing 34 may be formed as a generally mirror image of the upper housing 32 extending along the length of the body 12 from the tool end 14 to the handle end 16. In this regard, it may be appreciated that the body 12 may be provided in a variety of alternative configurations suitable for housing the drive gear 70 and clutch gear 60. Regardless of the specific arrangement, the body 12 may be configured to house the drive gear 70 and clutch gear 60 such that the drive gear teeth 78 that extend around a drive gear body 74 of the drive gear 70 are maintained in intermeshing engagement with the clutch gear teeth 66 that extend around a clutch gear body 64 of the clutch gear 60.

Referring still to FIGS. 3-5, rotational support for the drive gear 70 may be facilitated by the incorporation of drive gear bores 46 extending through the head portion 18 of the body 12. In an embodiment, the lower housing 34 may include a drive gear bore 46 formed coaxially relative to the housing recess 52. Likewise, as shown in FIG. 4, the drive gear bore 46 may also be formed in the upper housing 32 and may be coaxially aligned with the drive gear bore 46 formed in the lower housing 34. The drive gear 70 may include upper and lower drive gear flanges 76 which may extend axially upwardly and downwardly from the drive gear body 74. The drive gear flanges 76 may be sized and configured complementary to the drive gear bores 46. The drive gear bores 46 in the upper and lower housing 32, 34 may be sized and configured to provide a rotating fit with an outer circumference of the upper and lower drive gear flanges 76 of the drive gear 70. Optionally, at least one of the upper and lower housings 32, 34 may include a bushing or bearing in the drive gear bores 46 for rotatably supporting the upper and lower drive gear flanges 76.

Figure 9:
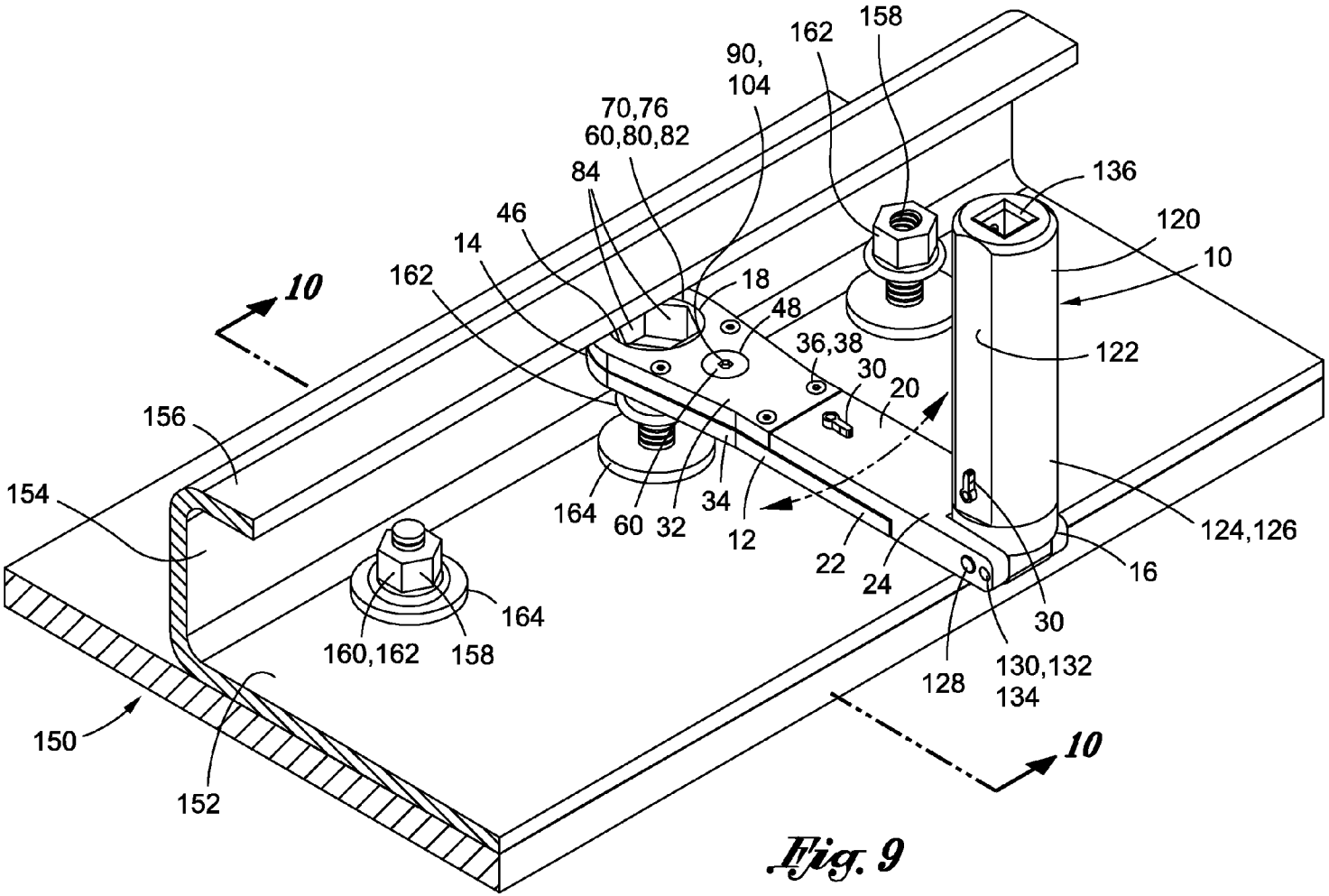
FIG. 9 is a perspective illustration of the wrench in a fastener installation having limited overhead access.

As best seen in FIG. 3, the drive gear 70 may include a drive element 82 which may be sized and configured for engaging the member 158. As was earlier mentioned, the member 158 may comprise a nut 162, a bolt head or any other fastener 160 or non-fastener configuration for which rotation is required. As shown in FIGS. 9 and 10, the wrench 10 is illustrated as being applied to a nut 162 of a fastener 160 installation. In this regard, the drive element 82 of the drive gear 70 is formed or shaped to engage the member 158. More specifically, the drive element 82 may include surface features such as flats 84 for engaging one or more surfaces or sides of the member 158. In the embodiment shown in FIG. 3, the flats 84 of the drive element 82 may form a hex shape for engaging a corresponding hex shape of the nut 162 shown in FIGS. 9-10. However, the drive element 82 may be configured in any one of a variety of alternative configurations such as, without limitation, in a 12-point configuration having a plurality of teeth or flutes to engage a hex shaped or a double-hex shaped bolt head, nut 162 or other member 158 configuration.

Referring still to FIGS. 3-5, the body 12 may further include one or more clutch gear bores 48 formed in the upper and lower housing 32, 34 for rotatably supporting the clutch gear 60. As was earlier mentioned, the clutch gear 60 may comprise the clutch gear body 64 having clutch gear teeth 66 formed equiangularly about a perimeter of the clutch gear body 64. The clutch gear teeth 66 are configured to be complementary to the drive gear teeth 78 such that intermeshing of the teeth minimizes or eliminates backlash between the drive gear 70 and the clutch gear 60. The clutch gear 60 may be rotatably supported on the unidirectional, non-reversible roller clutch 90 which may be fixed within the head portion 18 by means of a clutch shaft 104. The clutch shaft 104 may be extended through or engaged to the clutch gear bores 48 formed in the upper and lower housings 32, 34 as best seen in FIGS. 3 and 4.

Figure 8:
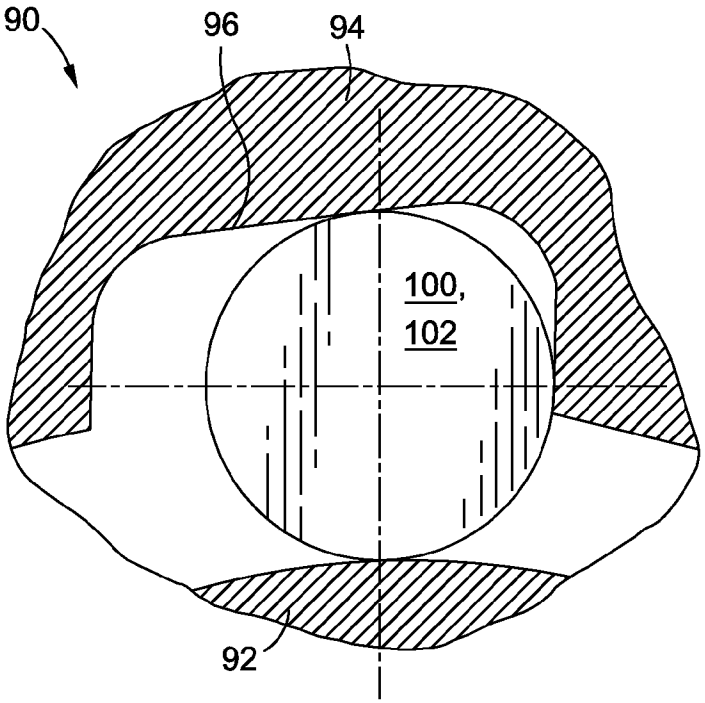
FIG. 8 is an enlarged illustration of a taper surface which may be incorporated into the inner and/or outer race such that relative rotation thereof is limited to a single direction.
Figure 7:
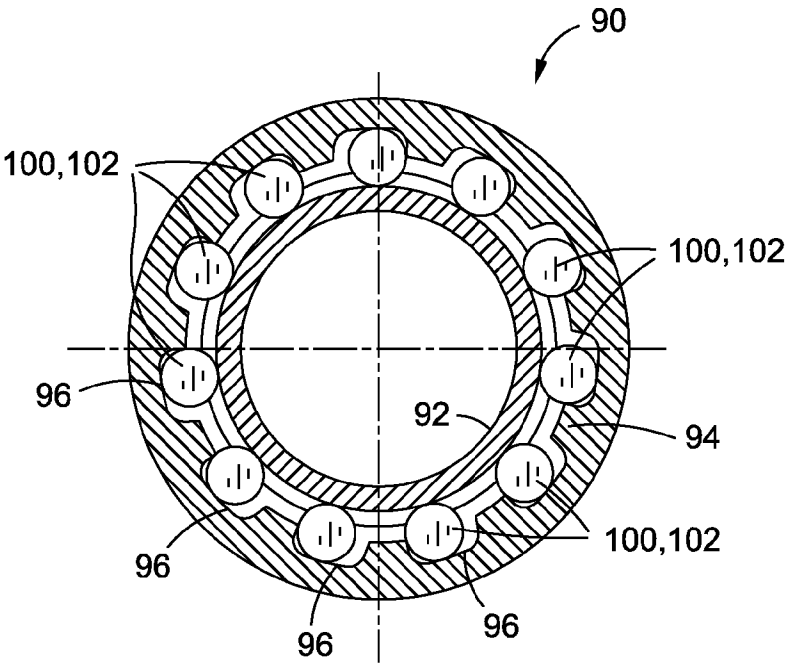
FIG. 7 is an enlarged sectional illustration taken along line 7-7 of FIG. 6 and illustrating the roller clutch having an inner race and an outer race and including a plurality of bearing elements.

Referring to FIGS. 5-8, the roller clutch 90 may be configured as a roller assembly comprising an outer race 94 rotatably coupled to an inner race 92 by means of a plurality of bearing elements 100 such as needle rollers 102. As shown in FIGS. 7-8, the outer race 94 is coaxially mounted relative to the inner race 92. The outer and inner races 94, 92 may form a radial gap. The roller clutch 90 may includes a plurality of the bearing elements 100 such as needle rollers 102 within the radial gap for maintaining relative radial positioning of the outer race 94 and inner race 92. The clutch gear 60 is preferably fixedly mounted to the outer race 94. The inner race 92 is preferably fixedly or non-movably mounted to the clutch shaft 104. The roller clutch 90 is arranged such that the outer race 94 rotates in a single direction relative to the inner race 92. In this manner, the roller clutch 90 functions as a ratcheting mechanism for the wrench 10 with essentially zero backlash as will be described in greater detail below.

Referring to FIG. 6, the clutch shaft 104 is shown extending through the body 12 and, more particularly, through the clutch gear bores 48 formed in the lower and upper housings 34, 32. The clutch shaft 104 may be configured in any number of different configurations for supporting the clutch gear 60. For example, the clutch shaft 104 may be formed as a unitary shaft element or as a multiple-part arrangement to facilitate assembly and maintenance of the drive mechanism 80. As shown in FIG. 6, the clutch shaft 104 may comprise a self-locking shaft stud 106 which may be threadably engageable to a shaft receptacle 108. The shaft receptacle 108 may have an outer diameter which is formed complementary to the inner diameter of the inner race 92.

The outer diameter of the clutch shaft 104 may be configured to provide an interference fit with the inner diameter of the inner race 92 in order to fixedly and/or non-rotatably secure the roller clutch 90 to the clutch shaft 104 in a manner that prevents axial motion of the roller clutch 90 relative to the clutch shaft 104. The clutch shaft 104 may be provided in a countersunk arrangement wherein the shaft stud 106 and shaft receptacle 108 may each include a countersunk head to engage a countersunk clutch gear bore 48 formed in respective ones of the lower and upper housing 34, 32. However, the clutch shaft 104 may be provided in any configuration that is suitable for non-rotatably and axially fixing the roller clutch 90 relative to the clutch shaft 104. Likewise, the clutch shaft 104 is preferably mounted in a manner such that rotation thereof relative to the body 12 is prevented. For example, the clutch shaft 104 may be sized to provide an interference fit or press fit within the clutch gear bore 48 formed in the upper housing 32 and/or lower housing 34. In this regard, the shaft receptacle 108 may be sized to form an interference fit with the clutch gear bore 48 in the lower housing 34. However, a variety of alternative means may be incorporated into the wrench to fixedly (i.e., non-rotatably) secure the clutch shaft 104 to the body 12.

Referring to FIGS. 7 and 8, shown is an enlarged sectional illustration of the roller clutch 90 illustrating the configuration of the outer race 94 relative to the inner race 92. In this regard, the outer race 94 is configured to rotate in a single direction relative to the inner race 92. Rotation of the outer race 94 in an opposite direction is prevented due to the configuration of the outer and inner races 94, 92. More specifically, as shown in FIG. 7, the outer race 94 may be provided with a plurality of taper surfaces 96 or any other suitable configuration that limits rotation of the outer race 94 to a single direction relative to the inner race 92. As can be seen in FIG. 8, the taper surface 96 may be formed at each location of the bearing element 100. Although the outer race 94 may freely rotate in a counterclockwise direction, the taper surface 96 in the outer race 94 acts as a wedge into which the bearing elements 100 may be engaged and preventing clockwise rotation of the outer race 94 relative to the inner race 92.

It should be noted that the specific arrangement of the roller clutch 90 illustrated in FIGS. 7 and 8 is illustrative of an embodiment thereof and is not to be construed as limiting alternative configurations or arrangements for providing unidirectional rotation of the outer race 94 relative to the inner race 92. For example, the taper surface 96 may be formed on the inner race 92 with the outer race 94 having a generally cylindrical shape. Likewise, the roller clutch 90 may include an elastomeric or polymeric element mounted with the radial gap between the inner and outer races 92, 94 and which may be configured to at least partially engage one or more of the bearing elements 100 to prevent rotation of the outer race 94 in one direction relative to the inner race 92. In addition, the bearing elements 100 may be configured in a variety of configurations or combinations of configurations including, but not limited to, roller bearings, ball bearings and/or as elongate, cylindrically-shaped needle rollers 102 illustrated in FIGS. 5-8.

In operation and referring to FIGS. 1-10, the wrench 10 may be engaged to a member 158 such as a fastener 160 as illustrated in FIGS. 9 and 10 to allow for rotation thereof in a desired direction. For example, as shown in FIG. 9, the wrench 10 may be engaged to a nut 162 and washer 164 mounted on a threaded shaft, stud of a fastener 160 installation in a work piece 150. In an embodiment, the work piece 150 may comprise a skin member having a stringer mounted thereto. The stringer may include a base 152 having a web 154 extending vertically upwardly therefrom and having a flange 156 extending laterally outwardly from the web 154. As can be seen in FIG. 10, the laterally outwardly extending flange 156 may restrict overhead space for engaging the nut 162 of the fastener 160 installation with a conventional socket or conventional open end or box end wrench. In this regard, the wrench 10 provides a low profile tool that facilitates engagement of the drive element 82 of the wrench 10 with the nut 162 of the fastener 160 installation.

The body 12 of the wrench 10 may be axially extensible in a manner as illustrated in FIG. 1 to increase the leverage or moment arm which may be applied at the drive element 82. Likewise, the gripping portion 120 may be oriented at a desired angle relative to the body 12 to facilitate manipulation of the wrench 10 by the operator such as to avoid structure when rotating the wrench 10 or to increase leverage. The detents 130 formed in the gripping portion 120 may facilitate fixing the orientation of the gripping portion 120 relative to the body 12.

When torque is applied to a member 158 such as the nut 162 illustrated in FIGS. 9-10, the unidirectional roller clutch 90 provides resistance by restricting rotation of the outer race 94 to one direction relative to the inner race 92. Such resistance may be effectuated through the geometry in the inner and outer races 92, 94 or using any other suitable mechanism incorporated into the inner and/or outer races 92, 94 such as the taper surfaces 96 shown in FIG. 7. The inner race 92 is preferably fixedly mounted to the clutch shaft 104 in a manner that resists rotation of the inner race 92 relative to the body 12. The roller clutch 90 is preferably sized and configured to provide sufficient resistance to a predetermined or predicted torque level. For example, the roller clutch 90 may be provided in a relatively large diameter in order to increase the torque capability of the wrench 10. The roller clutch 90 may include needle rollers 102 between the inner and outer races 92, 94 in order to provide increase surface area contact with the inner and outer races 92, 94 as compared to ball bearings. The clutch gear 60 may also be provided in a larger diameter relative to the drive gear 70. As may be appreciated, the relative sizes of the clutch gear 60, drive gear 70 and roller clutch 90 may be selected depending upon loading conditions.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. A method of rotating a member, comprising the steps of:
engaging the member with a drive element directly coupled to a drive gear, the drive gear being operatively coupled to a roller clutch; and
limiting, using the roller clutch, rotation of the drive element to a single direction such that rotation in an opposite direction is prevented.

2. The method of claim 1 further comprising the step of:
rotating inner and outer races of the roller clutch in a single direction relative to one another.

3. The method of claim 1 further comprising the step of:
rotating the drive gear of the drive element in a direction opposite the clutch gear mounted to the roller clutch.

4. The method of claim 3 further comprising the step of:
operatively coupling a perimeter of the drive gear to a perimeter of the clutch gear.

5. The method of claim 4 wherein the coupling step comprises:
intermeshing a set of teeth of the drive gear with a set of teeth of the clutch gear.

6. The method of claim 1 further comprising the step of:
housing the drive element within a body.

7. The method of claim 6 wherein the step of housing the drive element comprises:
housing the drive element within a chamber formed by an upper and lower housing.

8. The method of claim 7 further comprising the step of:
interlocking the upper housing to the lower housing.

9. The method of claim 6 further comprising the step of:
extending a movable portion of the body along an axial direction of the body to increase a length thereof.

10. A method of rotating a member, comprising the steps of:
engaging the member with a drive element directly coupled to a drive gear;
operatively coupling the drive gear to a roller clutch configured to limit rotation of the drive element to a single direction; and
rotating the drive element.

11. The method of claim 10 further comprising the step of:
rotating inner and outer races of the roller clutch in a single direction relative to one another.

12. The method of claim 10 further comprising the step of:
rotating the drive gear in a direction opposite a clutch gear mounted to the roller clutch.

13. The method of claim 12 further comprising the step of:
coupling a perimeter of the drive gear to a perimeter of the clutch gear.

14. The method of claim 13 wherein the coupling step comprises:
intermeshing a set of teeth of the drive gear with a set of teeth of the clutch gear.

15. The method of claim 10 further comprising the step of:
housing at least one of the drive element, the drive gear, and the roller clutch within a body.

16. The method of claim 15 wherein the housing step comprises:

housing at least one of the drive element, the drive gear, and the roller clutch within a chamber formed by an upper housing and a lower housing.

17. The method of claim 16 further comprising the step of:

interlocking the upper housing to the lower housing at a tool end of the body.

18. The method of claim 17 further comprising the steps of:

axially extending a movable portion of the body away from the tool end to increase a length of the body.

19. A method of rotating a fastener, comprising the steps of:

engaging the fastener with a drive element having a drive gear;

operatively coupling a perimeter of the drive gear to a perimeter of a clutch gear mounted to a roller clutch;

rotating the drive element in a single direction allowed by the roller clutch such that rotation of the drive element in an opposite direction is prevented; and rotating the fastener in response to rotating the drive element.

* * * * *